US006571976B1

(12) United States Patent
Sonnabend

(10) Patent No.: US 6,571,976 B1
(45) Date of Patent: Jun. 3, 2003

(54) INSULATED CONTAINER SLEEVE WITH SUCTION BASE

(76) Inventor: Gene H. Sonnabend, 3381 N. Hills Dr., Hollywood, FL (US) 33021

( * ) Notice: Subject to any disclaimer, the term of this patent is extended or adjusted under 35 U.S.C. 154(b) by 0 days.

(21) Appl. No.: 09/713,483

(22) Filed: Nov. 15, 2000

(51) Int. Cl.[7] ..... B65D 25/24; B65D 25/00

(52) U.S. Cl. ..... 220/483; 220/633; 220/634; 220/739; 220/737

(58) Field of Search ..... 220/632, 633, 220/634, 635, 630, 483, 737, 739

(56) References Cited

U.S. PATENT DOCUMENTS

| | | | | | |
|---|---|---|---|---|---|
| 177,617 | A | * | 5/1876 | Burnett | 220/633 |
| 300,944 | A | * | 6/1884 | Bowers | 220/633 |
| 801,564 | A | * | 10/1905 | Allen | |
| 1,165,052 | A | * | 12/1915 | Williams et al. | 220/632 |
| 1,741,783 | A | * | 12/1929 | Lower | 220/632 |
| 2,683,579 | A | * | 7/1954 | Wallace | 220/632 |
| 2,699,310 | A | * | 1/1955 | Evans | 220/632 |
| 2,839,260 | A | | 6/1958 | Jacobi, Jr. | |
| 3,355,049 | A | * | 11/1967 | Nolan et al. | 220/632 |
| 4,489,846 | A | * | 12/1984 | Nickel | 220/632 |
| D311,477 | S | | 10/1990 | Fallgatter et al. | |
| D348,807 | S | | 7/1994 | Cobb | |
| D351,970 | S | | 11/1994 | Barrio | |
| 5,447,764 | A | | 9/1995 | Langford | |
| 5,813,638 | A | * | 9/1998 | Morris | 220/632 |
| D416,764 | S | | 11/1999 | Gagne | |
| 6,000,575 | A | | 12/1999 | LaCour et al. | |
| 6,152,018 | A | * | 11/2000 | Yeh | 220/632 |

OTHER PUBLICATIONS

Copies of "L'IL SUCKER" suction device instructions in two sizes.

* cited by examiner

*Primary Examiner*—Joseph M. Moy
(74) *Attorney, Agent, or Firm*—Laurence A. Greenberg; Werner H. Stemer; Ralph E. Locher

(57) ABSTRACT

A sleeve for holding a container includes an enclosed wall and a flexible concave base defining an orifice. The flexible concave base connects to the cylindrical wall with the orifice within the enclosed wall. The flexible concave base opens away from said enclosed wall. The sleeve insulates the containers, holds the container, attaches the container to a surface, and eases the removal of the container from the sleeve.

19 Claims, 5 Drawing Sheets

INSULATED CONTAINER SLEEVE WITH SUCTION BASE

BACKGROUND OF THE INVENTION

1. Field of the Invention

The invention relates to a sleeve with a suction base and wall that covers, insulates, and secures a container. When a container is inserted into the sleeve, the sleeve secures the container to a surface from which the sleeve and container can be released easily. The sleeve holds the container in the sleeve until the user chooses to release the container, at which time, the orifice assists removal by preventing a vacuum from holding the container in the sleeve.

2. Description of the Related Art

Cozies hold, protect, and insulate containers held within them. Typically these containers are beverage containers such as bottles and cans. The cozy jackets covers and insulates most of the container while still allows the contents of the container to be reached. For example, in the case of a soda can, the sides and bottom of the can are jacketed while the top with an opening is left uncovered.

Prior-art cozies hold the container. The sleeve complements the shape and size of the container and is generally made of a flexible material. This combination leads to a sleeve that will hold the container within itself. This is important to prevent the container from slipping or unintentionally exiting the sleeve.

Cozies are generally made of an insulator. Insulators maintain the temperature (hot or cold) of the contents of the container held by the cozy. To produce insulators meeting the other physical requirements of the cozy, namely flexibility, closed-cell foams made from synthetic or natural rubber and neoprene are used.

Cozies have been made with suction cups attached to their bottom. The suction cup is attached to the bottom of the sleeve. While these prior-art suction designs do attach the sleeve to a surface, they do cause other shortcomings.

First, cans with suction cups added to their bottom increase the height of the sleeve. By raising the height of the container above the suction cup, the overall center of gravity of the sleeve is raised and the sleeve has an increased tendency to tip.

Second, the suction cups of the prior art have a solid bottom that connects to the wall of the sleeve. If this connection is airtight, the container will be difficult to remove from the sleeve because a vacuum forms within the sleeve as the container is withdrawn.

Attempts to prevent suction by placing holes in the prior-art cozies result in cozy that never creates a suction that holds the container. At times, a user might want the cozy to hold the container with a vacuum.

The following U.S. patents propose various sleeve designs. Each of the designs has at least one shortcoming.

Langford (U.S. Pat. No. 5,447,764) discloses an Insulated Retainer for a Beverage Container. The container has a cylindrical sleeve and flexible base. The flexible base is flat and prevents the can from tipping. The flexible base slides along the flexible base so that when the flexible base is placed along the top of the cylindrical sleeve, the container can be used to float a can in a pool and preventing the floating can from tipping. The container is made of a flexible, closed-cell foam, namely Nitrile Butadiene Rubber and Polyvinyl chloride. The container does not have an upwardly biased base. The container cannot act as a suction cup.

Barrio (U.S. Pat. No. D351,970) discloses a design for a Baby Food Jar Holder. The Baby Food Jar Holder has an upwardly biased bottom. The bottom extends wider than the cylindrical sleeve to stabilize containers being held. Because no hole is in the base, the container is difficult to remove from the holder because a vacuum forms as the container and base are pulled apart.

Gagne (U.S. Pat. No. D416,764) discloses a design for a Suction Cup Beverage Holder. The Holder has an upwardly biased bottom that acts as a suction cup. The bottom is not wider than the cylindrical sleeve so its ability to stabilize the container is minimal. Because no hole is in the base, the container is difficult to remove from the holder because the holder forms a vacuum within the holder when the container is removed.

LaCour et al. (U.S. Pat. No. 6,000,557) disclose a Movable Beverage Container Holder. The holder has a cylindrical sleeve. Stability is minimal because the base is not wider than the sleeve. A suction cup is attached to the bottom of the base. The suction cup is separate from the base. Because no hole is in the holder, the can forms a vacuum within the holder when the container is pulled apart from the holder.

Cobb (U.S. Pat. No. D348,807) discloses a design for a drink holder. The bottom is not wider than the cylindrical sleeve. Because no hole is in the holder, the can forms a vacuum within the holder when the container is pulled apart from the holder.

Fallgatter et al. (U.S. Pat. No. D311,477) describe a design for a Stabilizing Cup Holder. The holder has a conic wall and a flat base. The holder provides no suction to attach the holder to a surface.

Jacobi (U.S. Pat. No. 2,839,260) discloses a Non-Displaceable Receptacle. The receptacle has a hollow base with a piston, spring suction cup. Stability is not enhanced because the base is not wider than the sleeve. The piston raises the center of gravity of the container and decreases its stability on a surface. A suction forms when a container is removed from the receptacle.

SUMMARY OF THE INVENTION

It is accordingly an object of the invention to provide an insulated container sleeve with a suction base that overcomes the above-mentioned disadvantages of the heretofore-known devices and methods of this general type.

With the foregoing and other objects in view there is provided, in accordance with the invention, a sleeve for holding a container including an enclosed wall, a flexible concave base, and an orifice. The flexible concave base connects to the cylindrical wall with the orifice within the enclosed wall. The flexible concave base opens away from said enclosed wall.

In accordance with another feature of the invention, the enclosed wall complements the container. In the case of a drink can, the enclosed wall would be cylindrical. In the case of the container being a bottle, the enclosed wall would be shaped like the bottle.

In accordance with another feature of the invention, the enclosed wall is an insulator. In particular, the enclosed wall can be a resilient, flexible, closed-cell foam made from natural or synthetic rubber or neoprene.

In accordance with another feature of the invention, the flexible concave base can be formed by making a washer shaped piece of flexible, malleable material, wherein the washer has an inner diameter narrower than the enclosed wall and an outer diameter wider than the enclosed wall;

deforming the washer upward to form a cup shape; and then connecting the flexible concave base to the enclosed wall. The flexible concave base can be manufactured from a material such as neoprene.

In accordance with another feature of the invention, the flexible concave base is made through injection molding.

In accordance with another feature of the invention, the flexible concave base is inserted into the enclosed wall. Alternatively, the enclosed wall can be inserted into the concave base. To form an overall suction between the enclosed wall and the flexible concave base the connection between the two should be airtight. Adhesive can be used to from this airtight seal.

In accordance with another feature of the invention, the flexible concave base includes an abutment against which the container can rest. By having an abutment the container is placed at a height that becomes nearly level with the flexible concave base and the surface to which the sleeve is attached. By lowering the container relative to the surface, the container becomes less likely to tip.

In accordance with another feature of the invention, the enclosed wall is formed from a sheet that is folded onto itself to define a seam. This seam can be reinforced with adhesive and stitching.

In accordance with another feature of the invention, the flexible concave base is wider than the enclosed wall. This improves the overall stability of the sleeve and prevents it from tipping.

The sleeve holds a container to a surface while selectively releasing the container from the sleeve. When a container is inserted in the sleeve, the container forms an airtight fit with the wall. Then when the sleeve is placed onto a surface and the base is forced into a flat position, the sleeve is held on the surface by a vacuum formed with the flexible concave base. To release the sleeve, the base is peeled upward, the vacuum is released, and the sleeve is released from the surface. When the sleeve is released, the orifice in the base allows air to enter the sleeve and prevents a vacuum from forming within the sleeve when the container is removed from the base. However, when sleeve with container are fastened to a surface, the orifice is blocked and the same vacuum that holds the sleeve to the surface holds the container within the sleeve.

In accordance with another feature of the invention, the base forms the orifice and the enclosed wall surrounds the orifice. With such a configuration, once the container has been separated from the surface, the container can be released from the enclosed wall because any vacuum is alleviated by air entering through the orifice. When the container is inserted and the base is compressed on a surface, the can and the sleeve are held to the surface and the vacuum cannot discharge through the orifice.

In accordance with another feature of the invention, the orifice is formed on the enclosed wall and the wall is made from sufficiently flexible material to deform under the vacuum produced. This combination allows the container to be removed from the sleeve only when enough force is applied to overcome the vacuum formed and to deform the flexible enclosed wall. And once the bottom of the container passes the bottom of the orifice, the vacuum is discharged. In such an embodiment, the can is held when placed on the surface and the vacuum holds the container in the enclosed wall.

Other features that are considered as characteristic for the invention are set forth in the appended claims.

Although the invention is illustrated and described herein as embodied in an insulated container sleeve with a suction base, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
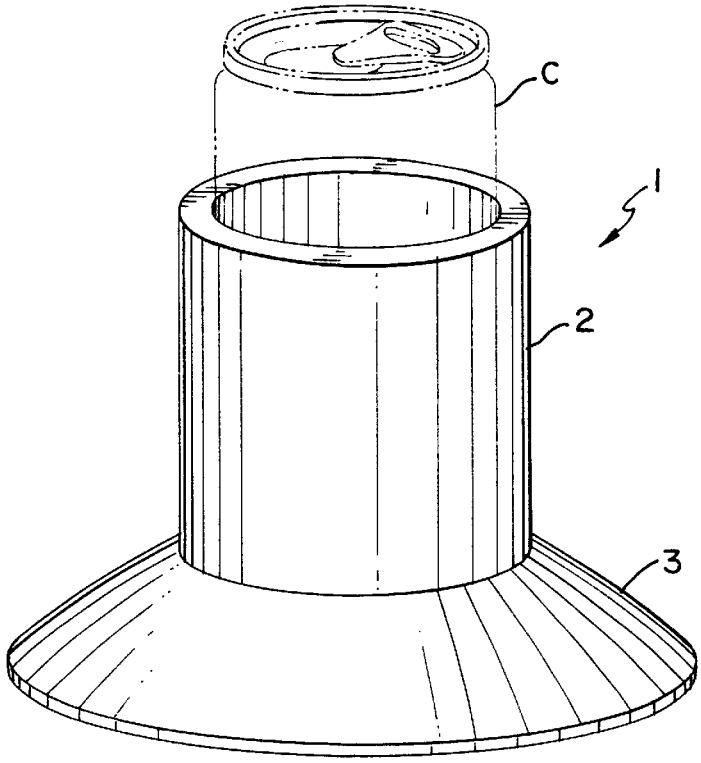
FIG. 1 is front elevational view of the sleeve holding a container shown in phantom.

Referring now to the figures of the drawing in detail and first, particularly, to FIG. 1 thereof, there is seen a sleeve 1 holding a container c. The sleeve 1 includes an enclosed wall 2 and a flexible concave base 3.

The enclosed wall 2 complements the shape of the container c. In the embodiment shown, the container c is a cylindrical soda can so the wall 2 is also cylindrical.

Preferably, the enclosed wall 2 is a thermal insulator. Closed-cell foams are preferable materials to form the enclosed wall 2. The enclosed wall 2 must not be permeable to air in order to ensure an air-tight seal with an inserted container. Neoprene is a most preferred material for constructing the enclosed wall 2, however natural rubber and other synthetic rubbers can be used to form the enclosed wall 2.

Figure 5:
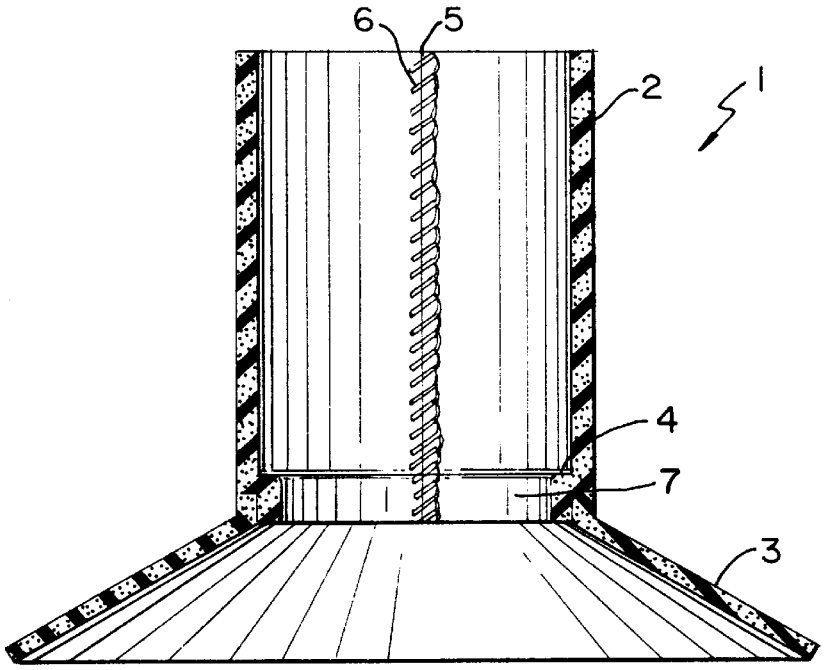
FIG. 5 is a cross sectional view of an alternate embodiment of the sleeve.

In FIG. 5, the enclosed wall 2 is formed by wrapping a rectangular sheet upon itself. The overlap forms a seam 5. The seam 5 is held with adhesive (not shown) and reinforcement such as stitching 6. The flexible concave base 3 opens away from the enclosed wall 2. The flexible concave base 3 contains an orifice 7.

The flexible concave base 3 is connected to the enclosed wall 2. The connection between the enclosed wall and the flexible concave base 3 is airtight and preferably includes an adhesive (not shown). The flexible concave base 3 opens away from the enclosed wall 2.

Figure 3:
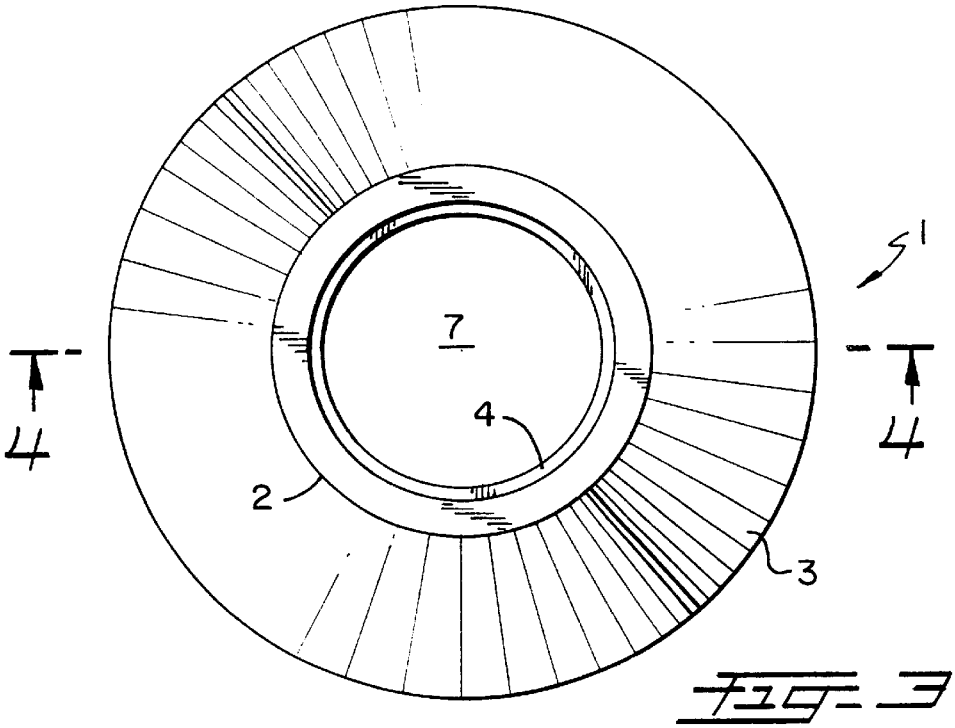
FIG. 3 is a plan view of the sleeve shown in FIG. 1.
Figure 4:
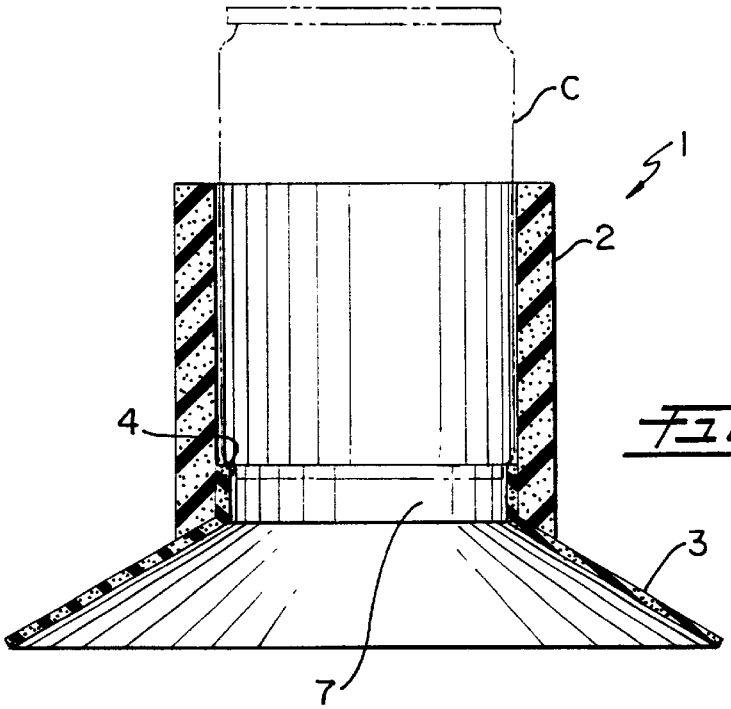
FIG. 4 is a side cross-sectional view of the sleeve, the cross section made along line 4 shown in FIG. 3.

FIGS. 3–5 reveal the construction of the sleeve 1. In FIGS. 3–4, the embodiment is made with the flexible concave base 3 inserted into the enclosed wall 2 so that the orifice 7 in the flexible concave base 3 is encircled by and attached to the enclosed wall 2.

In FIG. 5, an alternate embodiment is shown with the enclosed wall 2 inserted into the flexible concave base 3. When the flexible concave base 3 inserts into the enclosed wall 2, an abutment 4 is formed by the top of the flexible concave base 3. As shown in FIG. 4, the container c rests upon the abutment 4 when fully inserted into the sleeve 1.

In the embodiments shown in FIGS. 1–5, the flexible concave base 3 is preferably made of neoprene, however, natural rubber and other synthetic rubbers can also be used. Neoprene is a flexible insulator that can easily be joined to the enclosed wall 2.

Figure 6:
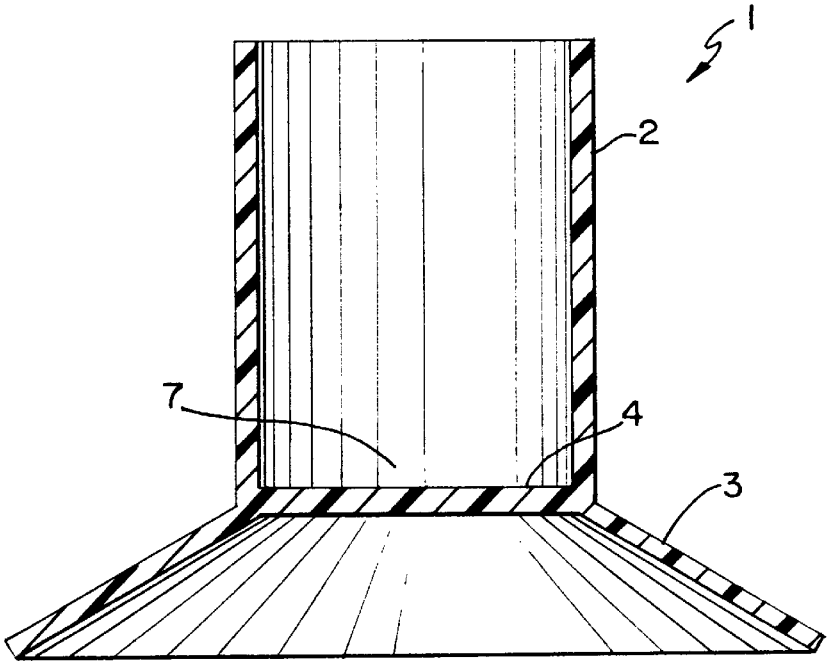
FIG. 6 is a cross-sectional view of a molded, one-piece sleeve.

FIG. 6 shows an embodiment wherein the enclosed wall 2 and flexible concave base 3 are molded as the same piece. In this embodiment the sleeve is made from a material suitable for injection molding.

Figure 7:
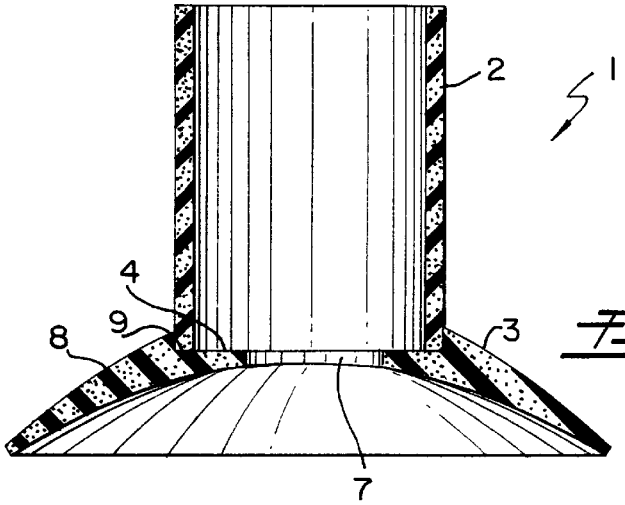
FIG. 7 is a side cutaway view of a sleeve with a molded base.
Figure 8:
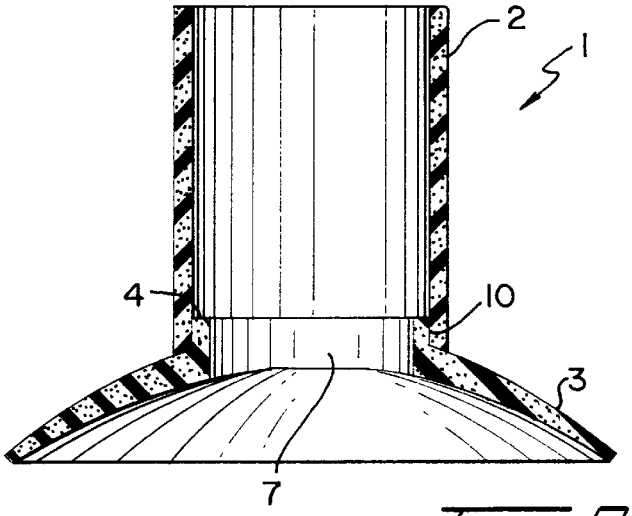
FIG. 8 is a side cutaway view of an alternate embodiment of sleeve with a molded base.
Figure 9:
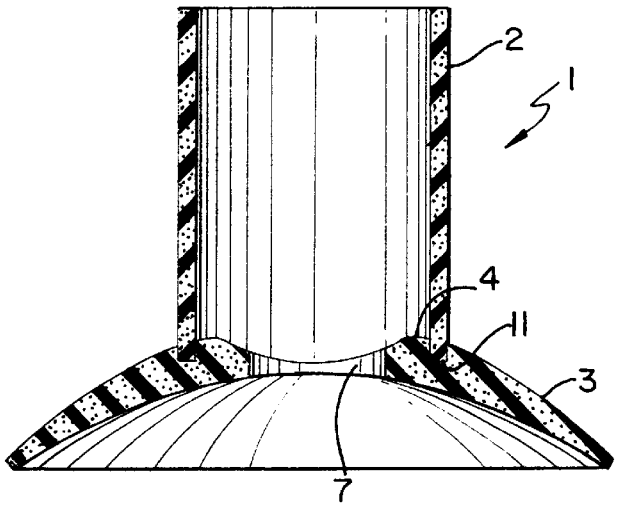
FIG. 9 is a side cutaway view of a further alternate embodiment of a sleeve with a molded base.

FIGS. 7–9 show embodiments of the sleeve wherein the flexible concave base 3 is molded. In these cases, the molded flexible concave base 3 is made of an airtight plastic. In FIG. 7, The flexible concave base 3 contains an indentation 9 in which the enclosed wall 2 is set. The embodiment in FIG. 7 also includes a tab 8 that can be used to pry the flexible concave base 3 from the surface s.

FIG. 8 shows an alternate molded embodiment of the flexible concave base 3. In this embodiment, the flexible concave base 3 includes a ridge 10 extending upward from the flexible concave base 3. The enclosed wall 2 fits over and attaches to the ridge 10.

FIG. 9 shows a further alternate embodiment of a molded flexible concave base 3. In this embodiment, the flexible concave base 3 includes a groove 11. The enclosed wall 2 inserts and is held in the groove 11.

Figure 2:
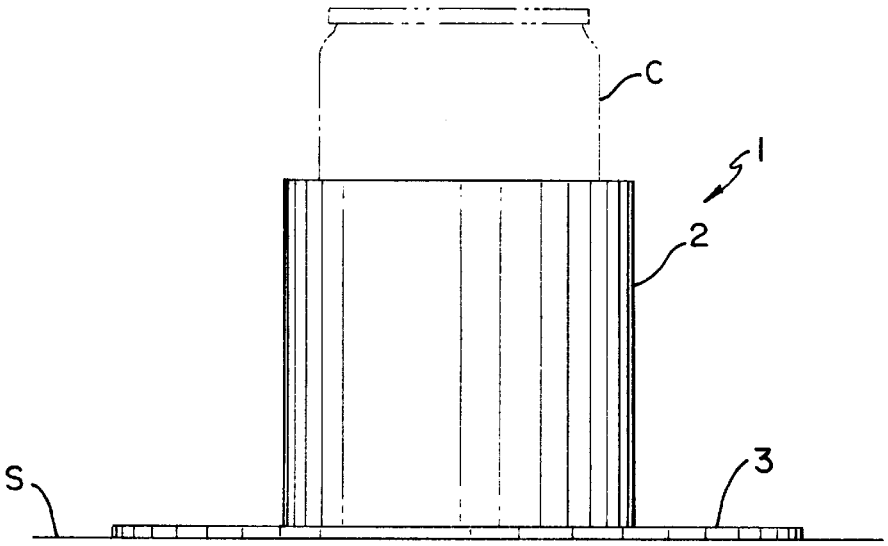
FIG. 2 is a side view of the sleeve shown in FIG. 1: the sleeve holding a container shown in phantom while attached with suction to a surface also shown in phantom.

In FIG. 2, the sleeve 1 is shown attached to a surface s. A suction that holds the sleeve 1 to the surface s forms when the sleeve is pressed toward the surface s and the flexible concave base 3 is forced into a flat position as shown. When the flexible concave base 3 is flattened and a container c is held, a vacuum forms and the sleeve is held onto the surface. In addition, this same vacuum holds the container c within the sleeve 1.

The stability of the sleeve 1 is further increased by the flexible concave base 3 extending wider than the enclosed wall 2 and container c. In this configuration, the flexible concave base 3 stabilizes the container c and prevents the container c from tipping.

When the concave base 3 is not attached to a surface s, no vacuum exists to hold the container c in the sleeve 1. This allows the container c to be easily released from the enclosed wall 2 when the sleeve 1 is not attached to a surface. Easy removal prevents unintended spill from a filled container c during removal from the sleeve 1.

Figure 10:
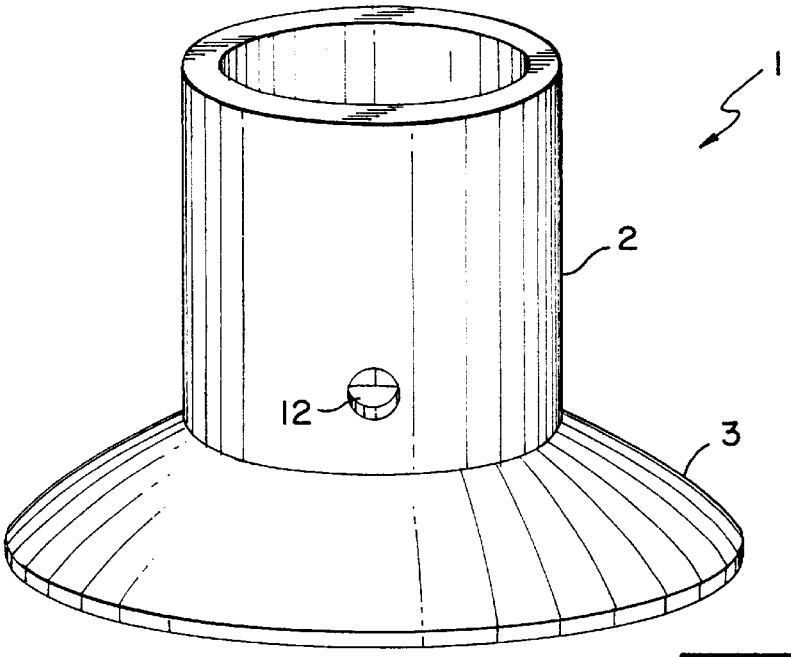
FIG. 10 is a perspective view of a further embodiment having a hole in the wall.
Figure 11:
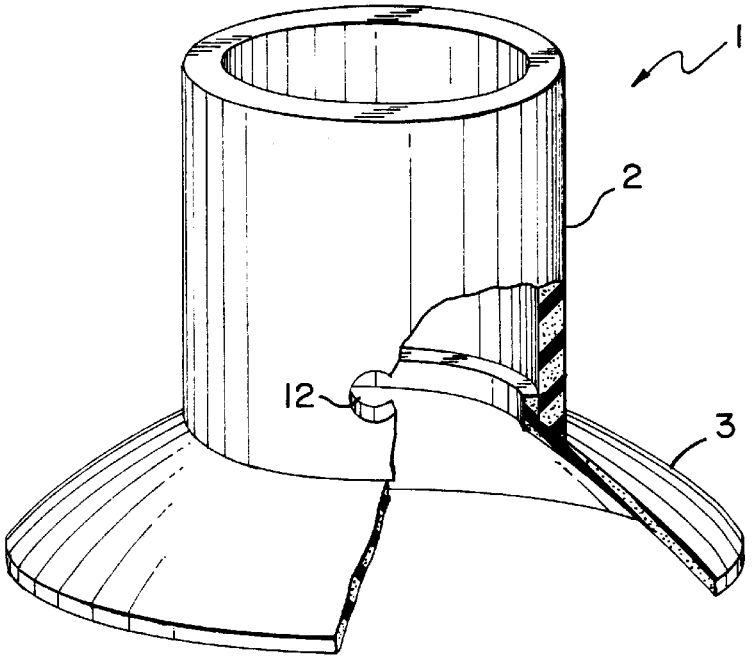
FIG. 11 is a partial cutaway view of the embodiment shown in FIG. 10.

FIGS. 10 and 11 show alternate embodiments of the invention wherein the orifice 12 is formed in the enclosed wall 2 above the concave base 3. In the embodiment in FIG. 10, no orifice 7 is defined in the concave base 2. When a container c is placed in the enclosed wall 2, below the orifice 12, an air-tight seal between the enclosed wall 2 and the container 2 create a vacuum that holds the container in the enclosed wall. The enclosed wall 2 is made of a flexible material that allows the container c to rise in the enclosed wall when enough force is applied to the container c to overcome the force of the vacuum. Once the container is lifted above the orifice 12, the vacuum is released and the container can be removed easily.

I claim:

1. A sleeve for holding a container comprising:

an enclosed insulating cylindrical wall having a bottom with an opening; and a flexible concave base defining an orifice, said flexible concave base connected airtightedly to said bottom of said cylindrical wall, said flexible concave base opening downwardly and below said bottom of said cylindrical wall and adhering by suction onto a surface when the container is inserted to form an airtight fit with said cylindrical wall, and said flexible concave base being pressed downwardly and flattened against the surface, and said cylindrical wall releasing the container without forming a vacuum when said concave base is not against the surface by allowing air through said opening.

2. The sleeve according to claim 1, wherein said flexible concave base is level with a bottom of the container when the flexible concave base is attached to a surface.

3. The sleeve according to claim 1, wherein said enclosed wall complements the container.

4. The sleeve according to claim 1, wherein said enclosed wall is chosen from the group consisting of neoprene, natural rubber, and synthetic rubber.

5. The sleeve according to claim 1, wherein said enclosed wall is a closed-cell foam.

6. The sleeve according to claim 1, wherein said flexible concave base inserts into said enclosed wall.

7. The sleeve according to claim 1, wherein said enclosed wall inserts into said concave base.

8. The sleeve according to claim 1, wherein said base is injection molded.

9. The sleeve according to claim 1, wherein said flexible concave base is chosen from the group consisting of neoprene, natural rubber, and synthetic rubber.

10. The sleeve according to claim 1, wherein said flexible concave base includes an abutment against which the container can rest.

11. The sleeve according to claim 1, wherein said enclosed wall and said flexible concave base connect airtightedly.

12. The sleeve according to claim 1, wherein said enclosed wall has a seam where said enclosed wall joins to itself.

13. The sleeve according to claim 12, wherein said seam is reinforced.

14. The sleeve according to claim 1, wherein said enclosed wall is attached to said flexible concave base with adhesive.

15. The sleeve according to claim 1, wherein said flexible concave base is wider than said enclosed wall.

16. The sleeve according to claim 1, wherein said flexible concave base defines an indentation and said enclosed wall rests in said indentation.

17. The sleeve according to claim 1, wherein said flexible concave base includes a ridge and said enclosed wall encircles said ridge.

18. The sleeve according to claim 1, wherein said flexible concave base defines a groove and said enclosed wall rests in said groove.

19. In a sleeve for holding a container, the sleeve having an enclosed insulating cylindrical wall with a bottom with an opening formed therein, an improvement comprising:

a flexible concave base defining an orifice, said flexible concave base connected airtightedly to said bottom of said cylindrical wall, said flexible concave base opening downwardly and below said bottom of said cylindrical wall and adhering by suction onto a surface when the container inserted to form an airtight fit with said cylindrical wall and said flexible concave base is pressed downwardly and flattened against the surface, and said cylindrical wall releasing the container without forming a vacuum when said concave base is not against the surface by allowing air though said opening.

* * * * *